US005083012A

United States Patent [19]

Edwards

[11] Patent Number: 5,083,012

[45] Date of Patent: Jan. 21, 1992

[54] RESISTANCE WIRE HEATING ELEMENT

[75] Inventor: Robert H. Edwards, Livingston County, Mich.

[73] Assignee: Custom Electric Manufacturing Company, Livonia, Mich.

[21] Appl. No.: 530,832

[22] Filed: May 30, 1990

[51] Int. Cl.[5] ..... H05B 3/10

[52] U.S. Cl. ..... 219/553; 219/552; 219/538; 219/539; 219/542; 392/480; 392/503; 373/134

[58] Field of Search ..... 219/202, 553, 552, 542, 219/544, 538, 539; 392/480, 488, 497, 503; 373/134

[56] References Cited

U.S. PATENT DOCUMENTS

| | | | |
|---|---|---|---|
| 838,884 | 12/1906 | McElroy | 219/539 |
| 1,449,406 | 3/1923 | Householder | 219/538 |
| 2,000,640 | 5/1935 | Jackson et al. | 219/539 |
| 2,429,303 | 10/1947 | Apatow | 219/538 |
| 3,673,385 | 6/1972 | Drugmand et al. | 219/539 |
| 4,233,494 | 11/1980 | Pawlik et la. | 219/539 |
| 4,721,847 | 1/1988 | Leverenz | 219/421 |

*Primary Examiner*—Bruce A. Reynolds
*Assistant Examiner*—Tu Hoang
*Attorney, Agent, or Firm*—Calfee Halter & Griswold

[57] ABSTRACT

An improved single heating element for a furnace, and method of designing the circuit is provided.

In the method of design and constructing the heating element, the voltage level of the furnace is determined, the operating temperature of the furnace is determined and then the watt level output is selected. A resistance wire is selected and the watt-density of the wire is calculated as if it were to be connected in a single strand in series. If the calculation yields a value greater than the maximum safe watt density, the watt-density is recalculated as if the wire were connected as two wires in parallel, and this calculation is repeated with an additional wire in parallel as many times as necessary to provide a watt-density less than the maximum safe watt density and constructing a furnace heating element with said finally determined number of wires in parallel.

7 Claims, 3 Drawing Sheets

RESISTANCE WIRE HEATING ELEMENT

BACKGROUND OF THE INVENTION

This invention relates generally to an improved resistance radiant tube heating element, more particularly to a heating element and method of making such element which has improved watt-density loading while maintaining a high power level.

Radiant tube heating elements generally operate in a tubular container which is mounted in a furnace. This protects the heating elements from being attacked by the gas atmosphere in the furnace. Within the tubular container is a length of metallic conductor or rod or resistance wire which heats due to resistance to flow of electric current. The length of rod or wire is ordinarily arranged in such a fashion that it is coiled or folded within the tubular container and connected to two terminals which usually extend from one end of the tubular container so that the two terminals can be attached to a power source.

Furnaces are usually designed with a multiplicity of heating elements to provide relatively uniform heating throughout the furnace. The heating elements preferably operate at a high kilowatt rating so that their physical size and the furnace size can be kept to a minimum; thus it is advantageous to provide elements that operate at a high-power.

Many furnaces are designed in such a way that the number of elements and tubes are limited; therefore, a high wattage is necessary to meet the heat requirements for the work passing through the furnace. One technique for generating designs for the elements involves reducing the diameter of the heating wire, which increases the wattage. However, this increases the watt density (watts per square inch of surface area radiating) of the wire which can cause or contribute to the premature failure of the heating wire or rod. A second design technique involves the installation of additional elements of the same size. However, this involves an increase of the physical dimensions of the furnace, which increases the heat losses and further increases the heating requirements and investment. Further, in many cases, the furnace is not equiped to be fitted with additional heating elements.

In some cases, the conductor is composed of graphite which is encased within the container and which contains an inert atmosphere such as nitrogen to prevent oxidation of the graphite. These elements are more expensive than metallic conductor elements and they are normally used in furnaces where the available space for the elements is limited. Graphite conductor elements can operate at a higher watt loading than metallic conductor elements and they are sometimes used for this purpose even though they require a non-oxidizing atmosphere for the element and water-cooled terminals to prevent overheating of the terminal area which adds to the costs.

In any type of resistance heating element the power is measured in watts (or kilowatts), wherein $W=EI$; and hence $W=E^2/R$ where W=watts, I=current, R=resistance and E=volts. Thus, with these basic conventional electrical relationships, it is apparent that the heating capacity or power of any element may be increased either by increasing the voltage (E) or reducing the resistance (R) of the conductor, assuming that the other (E or R) remains constant. The voltage normally will be dictated by the design of the furnace and the heating elements must be designed to the assumed, or selected, or existing, voltage utilized by the furnace. Also, the power or wattage of the furnace and each element is predefined. Thus, if voltage and wattage are known, the resistance of the element is thereby defined.

The required electrical resistance is achieved by controlling three variables. First, selecting a suitable alloy such as a conventional nickel-chromium alloy or an iron base alloy (e.g. iron-chromium-aluminum alloys) which has a known electrical resistance. There are many commercially available nickel-chromium alloys, and iron based alloys designed for use as heating elements. Second selecting a particular size and shape (smaller conductors have greater resistance per unit length). Third, determining the length required to develop the total resistance required (longer conductors have greater resistance). When a potential solution is formulated using the three selection options above, it must be evaluated from several perspectives to see if it would be feasible to produce such an element. These perspectives include the dimensional limitations on the element (will it fit in the furnace), the spacing of the conductor loops in the element and watt loading that would result.

As indicated above, one of the critical variables that must be considered in designing heating elements is the watt-loading on the conductor in the element. Watt-loading, or watt-density, is defined as the watts±surface area of the conductor. In fact the watt-loading, or watt-density, is essentially a limit on the heat that can be generated by a conductor of any given diameter before it will suffer physical damage. The maximum depends on several factors including the material of the wire and the temperature to which the furnace is heated. Expressed another way, if the watt-loading is too high, this will result in a significant premature failure potential of the element. Premature failure results when the rod or wire loses its physical integrity. The loss of physical integrity can be identified or determined by either the rod or wire becoming so hot that the interior of the wire becomes liquid which melts through wire, which in turn will result in loss of electrical continuity, or by the rod or wire bending or sagging in use to such an extent it will touch another portion of the wire, or the casing in which it is maintained which in turn will cause shorting. In either case, the required electrical continuity of the wire is lost. Hence, as used herein, safe watt loading or safe watt density means a watt loading or watt density which if exceeded will result in loss of physical integrity which in turn means that the wire will either melt, or in its designed setting will sag to such an extent a short will occur.

On the other hand, it is desirable to increase the wattage of each heater element so as to increase the amount of heating provided by the heating element, the heating being equivalent to the watts. One way to increase the watts without increasing the watt loading would be to increase the diameter and the length of the wire or rod. This may not be feasible, however, because the additional length and/or diameter adds volume to the heating element and there may not be ample or sufficient space within the available space within the container to contain this additional volume and as wire size increases, bending or forming the wire becomes much more difficult.

Another limitation in heating element design is the electrical resistance of the terminal. If the current required by the design is too high, it may be necessary to water-cool the terminals which is an added cost to the furnace operator.

Thus, in designing conventional electrical resistance wire heating elements for furnaces, a barrier is reached which imposes a limitation on the wattage of a given heating element utilizing a wire or rod of optimum size.

SUMMARY OF THE INVENTION

According to the present invention, an improved furnace heating element and method of forming the same is provided. The element comprises a plurality of resistance wires or rods, said wires or rods being connected in parallel to form said heating element, the resistance wires being connectable to a pre-selected or given voltage source. Each of the resistance wires or rods is selected to be of a wire size and wire length such that the watt-density is less than the maximum safe watt density.

Two or more circuits within each tube provide for a higher wattage while keeping the watt density of the wire within or below the safe watt loading value. Longer or wider diameter tubes can be accommodated within some furnaces that cannot accept or be equipped for additional number of heating elements or tubes. This technique is especially advantageous where the heating capacity of an existing furnace needs to be increased to accommodate additional work through the furnace or enable the use of metallic elements where graphite elements have been required in the original design of the furnace.

DESCRIPTION OF THE PREFERRED EMBODIMENT

Figure 1:
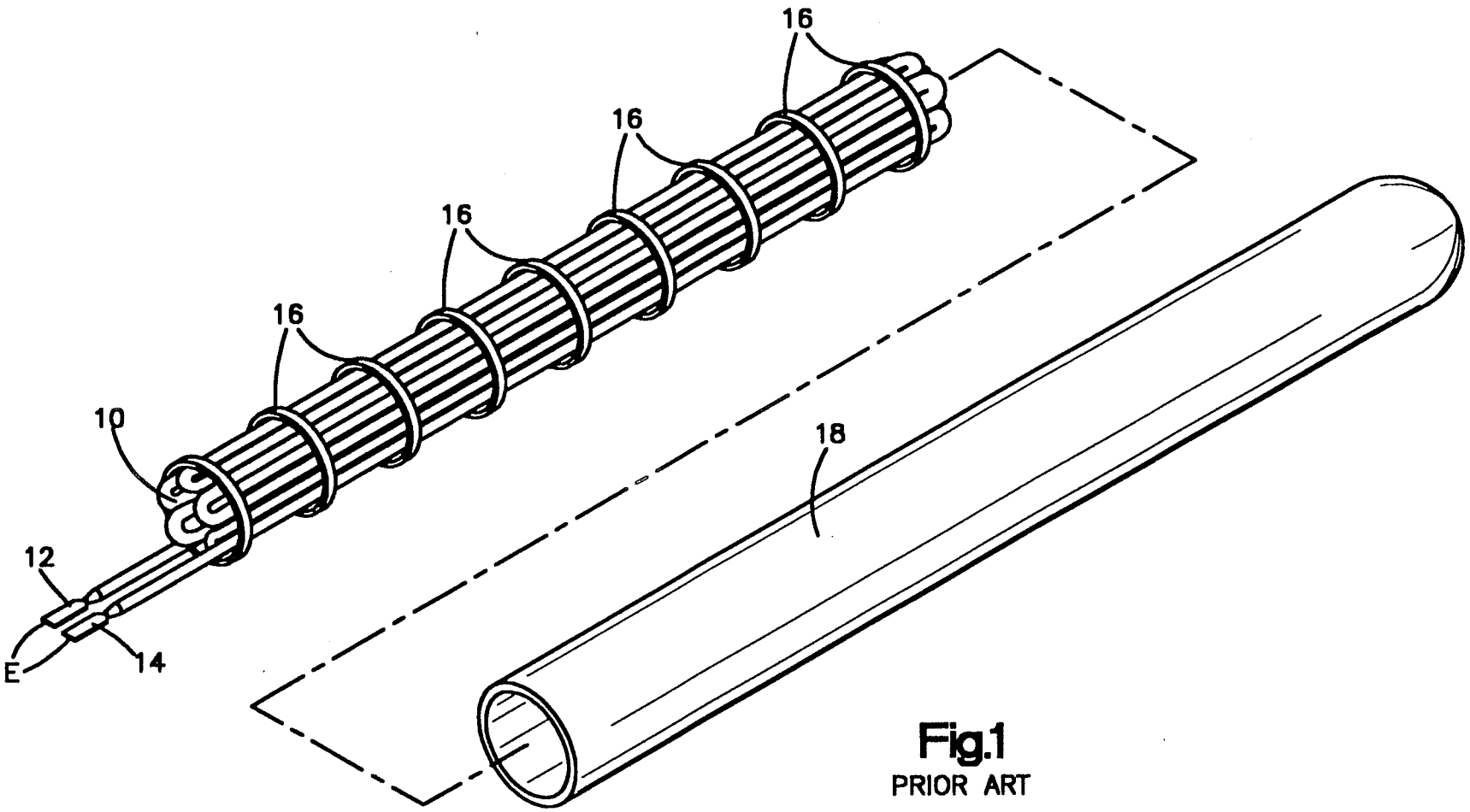
Fig.1 PRIOR ART
FIG. 1 is a perspective exploded view of a furnace heating element and tube, according to the prior art.

Referring now to the drawings and for the present to FIG. 1, a typical prior art heating element and encasing tube is shown. The heating element includes a resistance rod or wire 10 which is a single continuous rod, bent and/or joined to form a single heating element having a pair of ends 12 and 14. The rod 10 has a voltage E impressed thereacross, the voltage E normally being determined by the design of the furnace and thus fixed or given with respect to any given furnace. The rod is conventionally supported by ceramic spacer components 16 and disposed within a metallic casing 18 comprising a heater tube. Both ends of the rod extend from the same end of the tube for connection to a power source. The tube is secured to the furnace by a flange or other means (not shown). This is a conventional type of heating element.

In this design, the watt output of the heating element is determined by the equations $W=EI$ or $W=I^2R$ or $W=E^2/R$ where W is watts, E is voltage, I is current, and R is resistance. Hence with a fixed voltage, the watts are determined solely by the resistance of the heating element. Thus a calculation can be made to determine how many watts will be generated by any given length or a given size and type of wire. For example, if the voltage E is 48 volts, which is one conventional voltage level for electric elements, the watts will be equal to EI with the current being determined by the equation $I=E/R$. A simple calculation for obtaining a desirable level, for example, 13,300 watts, for a conventional iron based alloy wire such as type AF No. 1 gauge wire, manufactured by Kanthal Corp. of Bethel, Conn., is as follows: The diameter of No. 1 gauge is 0.289 inches. The resistance cold $R_c=0.10001$ ohms/-lineal foot. The resistance hot $R_H=1.06\times R_c$. The following design criteria to obtain 13,300 watts for this No. 1 gauge wire would utilize the following calculations:

Example I $$R_H = \frac{E^2}{W} = \frac{48^2}{13{,}300} = .1732 \text{ ohms} = R_H \quad (1)$$

$$R_C = \frac{R_H}{1.06} = \frac{.1732}{1.06} = .1634 \text{ ohms} = R_C \quad (2)$$

$$\text{Length} = \frac{.1634 \text{ ohms}}{.10001 \text{ ohms/ft}} = 16.33' = 195.92'' = \text{Length} \quad (3)$$

$$\text{Surface Area} = \pi DL = \pi \times .289'' \times 195.92'' = 177.88 \text{ sq. in.} \quad (4)$$

$$\text{Watt-Density} = \frac{\text{Watts}}{\text{Area}} = \frac{13{,}300 \text{ watts}}{177.88 \text{ sq. in.}} = 74.8 \text{ watts/sq. in.} \quad (5)$$

Figure 3:
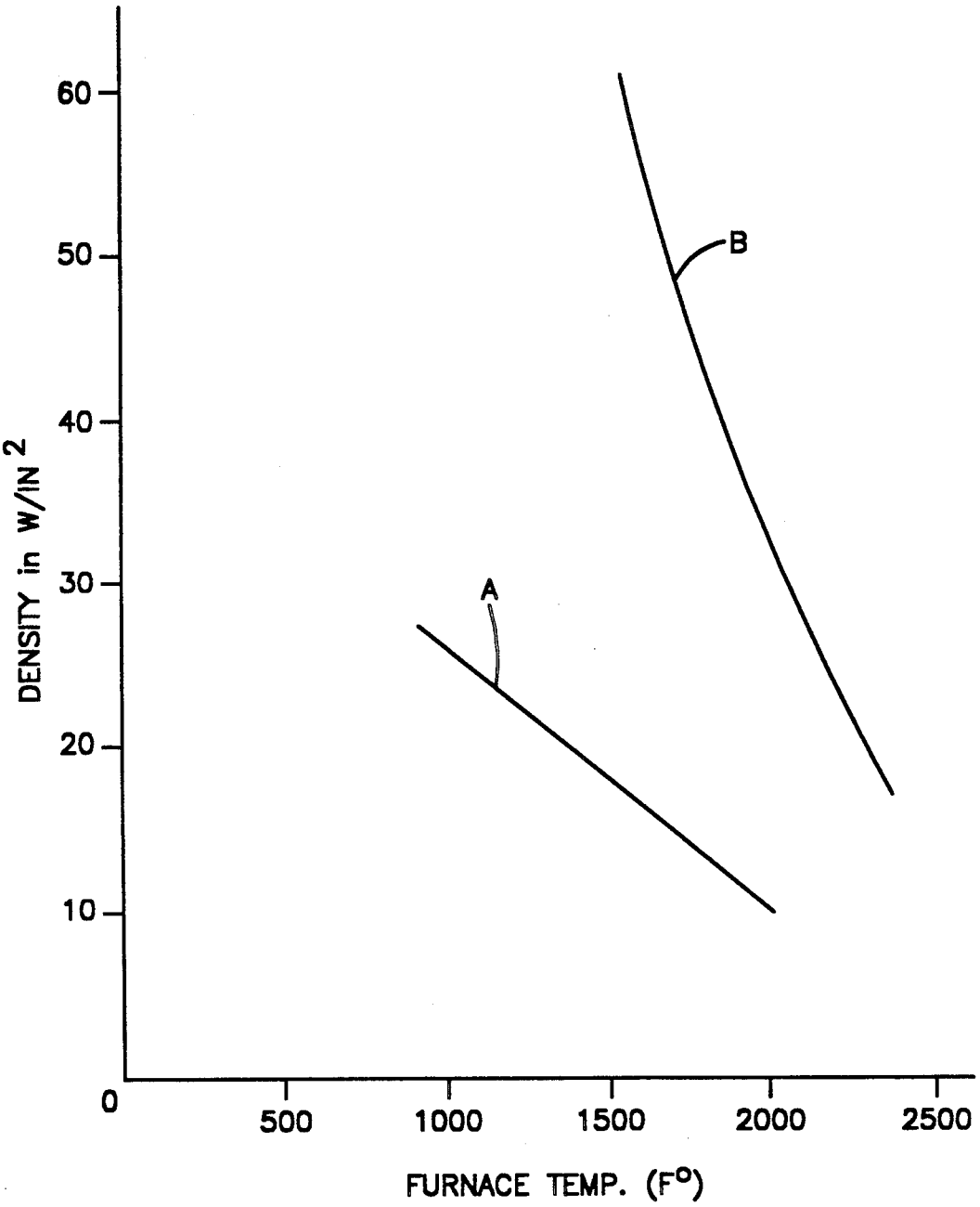
FIG. 3 is a graph depicting various maximum and optimum watt loadings for iron based alloy and nickel-chromium alloy heating elements.

Reviewing the equations, Equation 1 assumes that voltage given is 48 volts, the desired watt output is 13,300. Thus with these two given values, the resistance of the wire hot $R_H$, must be 0.1732 ohms. In order to obtain this resistance hot, the resistance of the wire cold $R_c$ must be chosen as shown in Equation 2 to be 0.1634 ohms. In Equation 3 the length of the wire to provide 0.1634 ohms cold is 16.33' or 195.92". The surface area is then calculated as shown in Equation 4 (which is for round wire), and watt-density is calculated as shown in Equation 5. When the watts are known and the area has been calculated, thus providing a total of 13,300 watts over surface area of 177.88 square inches, the watt-loading of 74.8 watts per square inch would be generated. It is necessary to determine now if this level of watt loading or watt density is above or below the maximum safe watt loading or watt density value. This can be determined experimentally very simply by constructing a heating element from the selected wire, and test it in the environment in which it is to be used to determine if it has the requisite physical integrity as defined above; i.e. does it either melt or short out after a reasonable time, e.g. 350 hours, causing loss of electrical continuity. If it does, then the maximum safe watt loading has been exceeded; if it does not, then the maximum safe watt loading has not been exceeded. However, these tests can normally be avoided by selecting commercially available heating rods or wires for which the manufacturer has already performed such tests and has published the safe watt loading values. FIG. 3 is a graph showing various maximum and optimum watt densities for different types of materials at various temperatures for different manufacturers' heating rod material. Upon examination of FIG. 3, it will be noted that the maximum safe watt loading for wires or rods varies significantly with different materials and very substantially with different temperatures. These curves show typical maximum values; however, these may vary slightly due to a variety of circumstances. Thus, when a design approaches these maximum values, one should conduct tests as described above to insure an adequate design.

Curve A shows the maximum watt loading for Ni-Cr wire based on the experience of the assignee; Curve B shows one manufacturer's (Kanthal Corporation of Bethel, Conn.) recommended maximum watt loading for iron based wire known and sold under the designation AF No. 1 by Kanthal Corporation.

Figure 2:
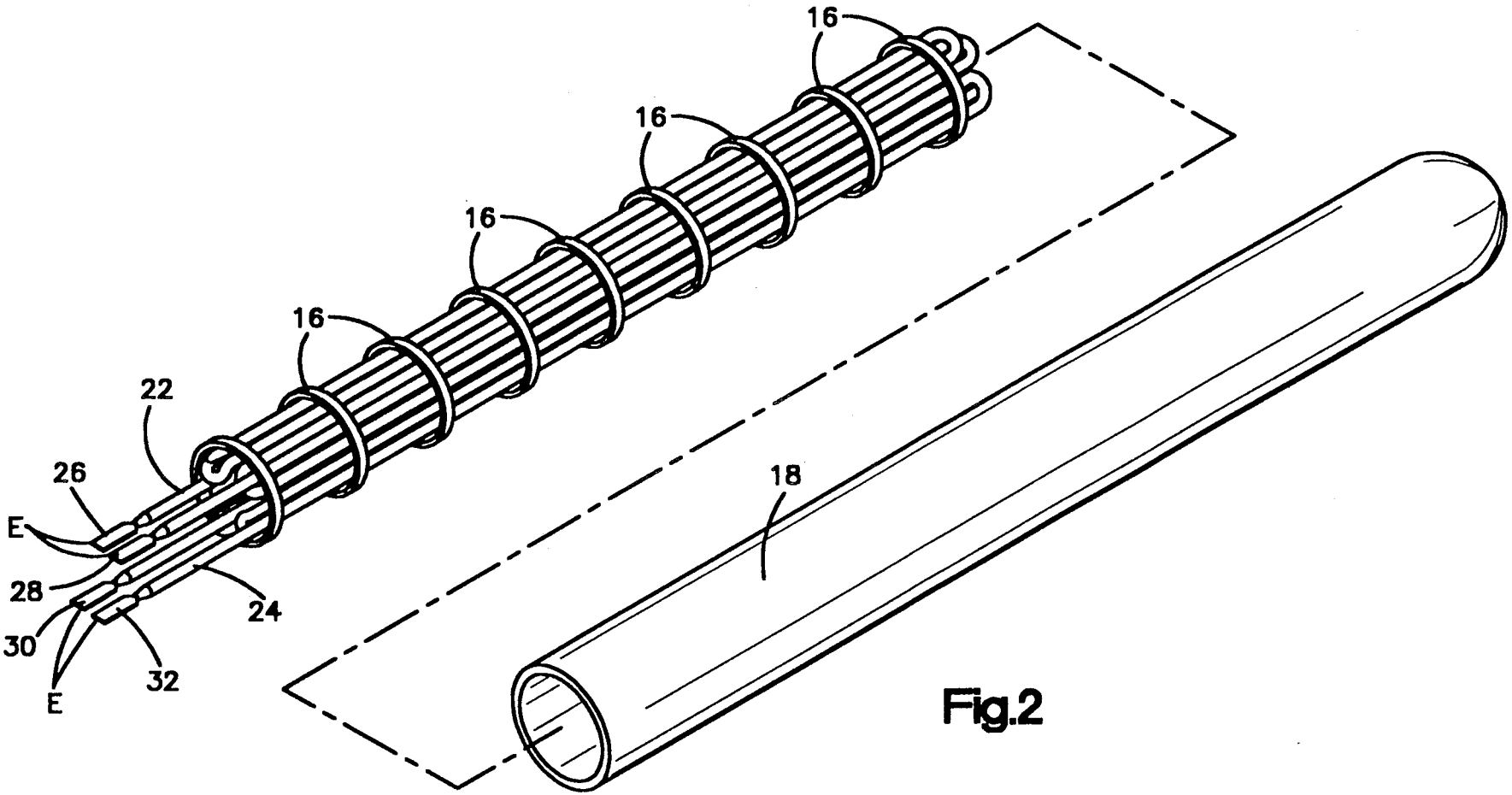
FIG. 2 is a perspective exploded view of a furnace heating element and tube according to this invention.

When a designer knows the operating temperature of the furnace, and operating parameters to which the elements are to be designed, one can forcast if a particular design of the heating rod might fail because of excessive watt loading. Thus, with respect to the calculations in Example 1 above, it can be seen that the design for iron based Kanthal AF No. 1, the watt loading would be too high at any temperature in excess of about 1,500° F. It would certainly be much too high at typical furnace heating levels of 1,800° F. and above. The requirement for watt loading of the iron type rod based on Curve B at 1,800° F. is that the watt loading must not exceed about 40 watts per square inch. This can be accomplished according to the present invention by using two resistance wires or rods connected in parallel circuits as shown in FIG. 2, wherein two separate wires or rods 22 and 24 are mounted on the insulator spacers 16. The rod 22 is formed such that it has two ends 26 and 28 extending at the same end thereof across which the voltage E is applied, and the rod 28 also has two ends 30 and 32 extending from the same end across which the same voltage E is also applied. As in the case of FIG. 1, the rods or wires are encased in a tube or casing 18.

By this technique, an output of 13,300 watts can be achieved within a single heater element of two parallel circuit rods. This is demonstrated by the following calculations for each circuit of the resistance:

Example II $$R_H = \frac{E^2}{W'} = \frac{48^2}{6650} = .3465 \text{ ohms} = R_H \quad (6)$$

$$R_C = \frac{R_H}{1.06} = \frac{.3465}{1.06} = .3269 \text{ ohms} = R_C \quad (7)$$

$$\text{Length} = \frac{.3269 \text{ ohms}}{.10001 \text{ ohms/ft}} = 32.65' = 391.83'' \quad (8)$$

$$\text{Surface Area} = \pi DL = \pi \times .289'' \times 391.83'' = 355.75 \text{ sq. in.} \quad (9)$$

$$\text{Watt Density} = \frac{\text{Watts}}{\text{Area}} = \frac{6650 \text{ watts}}{355.75 \text{ sq. in.}} = 18.7 \text{ watts/sq. in.} \quad (10)$$

As can be seen, the watt density in this case is only 18.7 watts per square inch, while achieving the desired 13,300 watts within the element. This is done by connecting exactly the same size type AF No. 1 wire in two parallel circuits with each circuit carrying half of the current, and generating half the power, i.e., 6,650 watts, and thus together, providing 13,300 watts.

In this set of equations, it is assumed that each of the circuits will carry half the current, therefore Equation 6 is similar to equation 1 but is for just one circuit of the total element; thus this circuit is designed to produce 6,650 watts. In this case the resistance of the one circuit must be 0.3465 ohms $R_H$. Equation 7 converts this to the resistance cold $R_c$, similar to the Equation 2. Equation 8 determines the length of each circuit, similar to Equation 3, and indicates that each circuit must be 32.65' or 391.83" long. Equation 9 determines the surface area of each of the circuits, and Equation 10 equates the watt-density and watts per square inch for each of the circuits. As can be seen, while the length of each of the circuits is twice that of a single rod element shown in FIG. 1, the overall result is to provide the same amount of watts which would have been produced by a single element at one-fourth of the watt-density, i.e. 18.7 watts/square inch), and hence, loading within the acceptable range even for the conventional nickel-chromium alloy.

As seen in the curves of FIG. 3, the watt loading of 18.7 per square inch is well below the maximum for Kanthal AF No. 1 wire at 1,800° F.

Table I below shows calculations based on the above equations to determine the necessary length and the watt loadings for developing 13,330 watts at 48 volts with various wire sizes from 0 through 7 for a particular wire material. As noted in the equations above, at the assumption of a wire size 1, it would take 16.32' to develop the necessary watts which would be at a watt loading of 74.15 watts per square inch. This table demonstrates why it would be difficult to achieve the necessary watt output with a single wire since going to a size 0 wire would still only reduce the watt loading down to 52.06 watts per square inch which is still very high with respect to Kanthal material and the size 0 wire is extremely difficult to work with and to bend, shape and form into a proper circuit because of the large diameter. Of course, with thinner wire, the wire size decreases but watt loading increases very rapidly up to size 7 wire in which the loading is over 600 watts per square inch which is obviously an order of magnitude larger than what is permissible.

TABLE I

WATT LOADING FOR 13,300 WATTS AT 48 VOLTS

| WIRE SIZE | DEVELOPED LENGTH (FEET) | WATTS/SQ. IN. |
|---|---|---|
| 0 | 21 | 53 |
| 1 | 16 | 74 |
| 2 | 13 | 105 |
| 3 | 10 | 151 |
| 4 | 8 | 213 |
| 5 | 6 | 299 |
| 6 | 5 | 424 |
| 7 | 4 | 606 |

Table II below is a calculation similar to that of Table I but wherein the values are developed for two parallel wires according to this invention. As can be seen, the watt loading drops from 74.15 to 18.53 watts per square inch for a size 1 wire. It may be permissible to use a size or two higher than that, e.g. size 2 or 3 wire to shorten the length and develop the watts necessary to do the heating, as can be seen in Table II. Size 3 wire can have a length of 20.42 feet and develop a watt loading of 37.70 watts/sq. in. which certainly is within the potential limits of certain Kanthal materials.

TABLE II

WATT LOADING FOR 6,650 WATTS AT 48 VOLTS

| WIRE SIZE | DEVELOPED LENGTH (FEET) | WATTS/SQ. IN. |
|---|---|---|
| 0 | 41 | 13 |
| 1 | 33 | 19 |
| 2 | 26 | 26 |
| 3 | 20 | 38 |
| 4 | 16 | 53 |
| 5 | 13 | 75 |
| 6 | 10 | 106 |
| 7 | 8 | 151 |

Example III shows a design for nickel-chromium wire wherein the total wattage has be 10,000 watts and is done with a single circuit. Example IV shows the developing of 10,000 watts using two parallel circuits of 5,000 watts each.

| EXAMPLE III | | |
|---|---|---|
| Assume: | | |
| Heating Wire | | Design #1 |
| Type A - 80% Ni 20% Cr | wire size | #1 |
| $R_{Hot} = 1.03\ R_{cold}$ | Dia. | .289 |
| oper temp - 1,800° F. | $R_{cold}$ | .007782 ohms/ft |
| E = 48 volts | circuits | 1 |
| | watts | 10,000 each |

$$R_{Hot} = \frac{E^2}{W} = \frac{48^2}{10{,}000} = .2304 \text{ ohms} = R_{Hot}$$

$$R_{cold} = \frac{R_{Hot}}{1.03} = \frac{.02304}{1.03} = .2237 \text{ ohms} = R_{cold}$$

$$\text{Length} = \frac{.2237 \text{ ohms}}{.007782 \text{ ohms/ft}} = 28.74' = 344.93'' = \text{Length}$$

$$\text{Surface Area} = \pi DL = \pi \times .289'' \times 344.93'' = 313.01 \text{ sq. in.}$$

$$\text{Watt Density} = \frac{\text{Watts}}{\text{Area}} = \frac{10{,}000}{313.01} = 31.9 \text{ watts/sq. in.}$$

The watt density is too high and the element will fail.

| EXAMPLE IV | | |
|---|---|---|
| Assume: | | |
| Heating Wire | | Design #2 |
| Type A - 80% Ni 20% Cr | wire size | #2 |
| $R_{Hot} = 1.03\ R_{cold}$ | Dia. | .258" |
| oper temp - 1,800° F. | $R_{cold}$ | .009765 ohms/ft |
| E = 48 volts | circuits | 2 |
| | watts | 5,000 each |

$$R_{Hot} = \frac{E^2}{W} = \frac{48^2}{5{,}000} = .4608 \text{ ohms} = R_{Hot}$$

$$R_{cold} = \frac{R_{Hot}}{1.03} = \frac{.04608}{1.03} = .4474 \text{ ohms} = R_{cold}$$

$$\text{Length} = \frac{.4474 \text{ ohms}}{.009765 \text{ ohms/ft}} = 45.81' = 549.77'' = \text{Length each}$$

$$\text{Surface Area} = \pi DL = \pi \times .258'' \times 549.77'' = 445.38 \text{ sq. in. each}$$

$$\text{Watt Density} = \frac{\text{Watts}}{\text{Area}} = \frac{5{,}000 \text{ watts}}{445.38 \text{ sq. in.}} = 11.23 \text{ watts/sq. in.}$$

This watt density is with the acceptable limit.

As can be seen in Example III, the watt loading of 31.9 watts is above that which can be used for Ni-Cr wire, whereas by providing parallel circuits, the watts loading, as shown in Example IV, is reduced to 11.23 watts per square inch by suing slightly smaller wire. Tables III and IV below are similar to Tables I and II above but show values of watt loadings and length required for developing 10,000 watts, Table III being for a single circuit and Table IV for two parallel circuits. Again, by the use of this Table, the desired length and watt loadings can be selected to be within the capabilities of the selected material and still provide the necessary watts for the heating of the furnace at whatever value is selected.

TABLE III

| WATT LOADING FOR 10,000 WATTS AT 48 VOLTS | | |
|---|---|---|
| WIRE SIZE | DEVELOPED LENGTH (FEET) | WATTS/SQ. IN |
| 000 | 58 | 11 |
| 00 | 46 | 16 |
| 0 | 36 | 22 |
| 1 | 29 | 32 |
| 2 | 23 | 45 |
| 3 | 18 | 64 |
| 4 | 14 | 91 |
| 5 | 11 | 128 |
| 6 | 9 | 181 |
| 7 | 7 | 258 |

TABLE IV

| WATT LOADING FOR 5,000 WATTS AT 48 VOLTS | | |
|---|---|---|
| WIRE SIZE | DEVELOPED LENGTH (FEET) | WATTS/SQ. IN |
| 000 | 116 | 3 |
| 00 | 92 | 4 |
| 0 | 73 | 6 |
| 1 | 57 | 8 |
| 2 | 46 | 11 |
| 3 | 36 | 16 |
| 4 | 29 | 23 |
| 5 | 23 | 32 |
| 6 | 18 | 45 |
| 7 | 14 | 65 |

Of course, if two strands of wire in parallel still provide too great a watt-density, the calculations can be repeated for three or more wires in parallel until satisfactory watt-density is achieved.

While one embodiment of the invention has been shown and described, various adaptions and modifications can be made without departing from the scope of the invention as defined in the appended claims.

What is claimed is:

1. A single heating element for use in an electrically heated furnace, which furnace has a gas atmosphere and a given operating temperature, said element comprising a plurality of heating resistance wires or rods, said wires being connected in parallel to form said heating element having a multiplicity of parallel circuits disposed in a common tube protecting the wires from the atmosphere of the furnace, said heating resistance wires being connectable in parallel to a preselected given voltage source, each of the resistance wires having a watt density defined as watts per square area, and wherein each wire has a maximum safe watt density at said given operating temperature, said wires being selected to be of a wire size and wire length such that the watt density of each of said wires forming each circuit is less than the maximum safe watt density of the wire at the furnace operating temperature and wherein a single circuit would require a wire which exceeds the maximum safe watt density.

2. The heating element as defined in claim 1 wherein said heating element is a radiant tube heating element.

3. The heating element as defined in claim 1 wherein said wires are a nickel chromium alloy.

4. The heating element as defined in claim 3 wherein the maximum safe watt density at said given operating temperature is defined by curve A in FIG. 3.

5. The heating element as defined in claim 1 wherein the wires are an iron based alloy.

6. The heating element as defined in claim 5 wherein the maximum safe watt density at said given operating temperature is defined by curve B in FIG. 3.

7. The heating element as defined in claim 1 wherein there are two circuits of substantially equal resistance.

* * * * *